US007065792B2

(12) United States Patent
Hautala

(10) Patent No.: US 7,065,792 B2
(45) Date of Patent: Jun. 27, 2006

(54) ARRANGEMENT IN A GARMENT FOR FASTENING AND DETACHING SUSPENSION MEMBER FOR A MOBILE TERMINAL DEVICE

(75) Inventor: Antti Hautala, Jyväskylä (FI)

(73) Assignee: Fanttiset Oy, Jyvaskyla (FI)

( * ) Notice: Subject to any disclaimer, the term of this patent is extended or adjusted under 35 U.S.C. 154(b) by 406 days.

(21) Appl. No.: 10/402,228

(22) Filed: Mar. 27, 2003

(65) Prior Publication Data

US 2004/0187183 A1 Sep. 30, 2004

(51) Int. Cl.
*A41D 27/20* (2006.01)

(52) U.S. Cl. ..... 2/69

(58) Field of Classification Search ..... 2/247–253, 2/69, 79, 69.5, 80, 102, 23, 93, 94, 100, 101, 2/305, 268, 459, 44, 45, 310, 326–328, 460–461; 224/201, 259, 264, 265
See application file for complete search history.

(56) References Cited

U.S. PATENT DOCUMENTS 4,168,544 A 9/1979 Kallman
4,599,750 A * 7/1986 Rahaman ..... 2/243.1
4,642,815 A 2/1987 Allen
5,586,704 A 12/1996 Alexander et al.
5,884,338 A * 3/1999 Golde ..... 2/247
6,015,217 A 1/2000 Colangelo et al.
6,047,404 A * 4/2000 Blanks, I ..... 2/69
6,553,579 B1 * 4/2003 Gillen et al. ..... 2/268

FOREIGN PATENT DOCUMENTS

| | | |
|---|---|---|
| DE | 20012075 | 11/2000 |
| FR | 2392616 | 12/1978 |
| GB | 478620 | 1/1938 |

OTHER PUBLICATIONS

"Materials" 'Online! 1998 , Sequel Outdoor Clothing XP002231052.

* cited by examiner

*Primary Examiner*—Tejash Patel
(74) *Attorney, Agent, or Firm*—Fildes & Outland, P.C.

(57) ABSTRACT

An arrangement in a garment for fastening and detaching at least one pocket includes an attachment member and an attachment counter piece, which are formed of a zip fastener. One half is attached to the garment and the other half to the upper edge of the pocket, in such a way that the pocket can be completely detached by opening the zip fastener. Here, the term "pocket" also refers to, for example, a knee protector or a suspension device for a mobile terminal device.

10 Claims, 9 Drawing Sheets

ARRANGEMENT IN A GARMENT FOR FASTENING AND DETACHING SUSPENSION MEMBER FOR A MOBILE TERMINAL DEVICE

TECHNICAL FIELD

The present invention relates to an arrangement in a garment for fastening and detaching suspension member for a mobile terminal device. A mobile terminal device means here e.g. a cell phone or a professional communication device.

BACKGROUND OF THE INVENTION

Pockets account for a significant part of the manufacturing costs of garments. In general, more than half of the manufacturing costs of a garment are due to making the pockets.

When garments are used, they usually wear only at specific places. Often, when garments are finally thrown away because, for example, they are worn through, their pockets are still completely intact.

Nowadays, billing for the care of garments is based on the weight of the garments involved. When large numbers of garments are handled, their pockets form a quite significant share of this weight.

Attempts have been made to solve these problems, among others, by means of several known pocket models, which are intended to be fastened to and detached from the wearer's garments. In known solutions, the attachment is arranged to take place using, for example, strips of VELCRO hook and loop fasteners or a safety pin. The U.S. Pat. Nos. 3,840,901, 4,266,300, 5,054,127, and 6,233,747 B1 disclose comprehensively various kinds of pocket-attachment solutions according to the state of the art.

Document U.S. Pat. No. 5,586,704 discloses a holder arrangement for a cell phone. There is a shoulder strap and side straps with a belt loop for supporting the holder.

French patent 2392616 presents a pocket-handbag combination. In a pocket mode there are the zips on the top and bottom of the pocket. When the both zips are opened, the pocket is detached. The zip halves of the pocket can be joined together to implement the hand-bag mode.

The aforementioned known carrying devices do not satisfy all groups of users. Those carrying devices don't bind the holder tightly on the garment. Also one object of the invention is to achieve suspension member for a mobile terminal device for uniforms of several professional groups like police, rescue, custom personnel.

SUMMARY OF THE INVENTION

The present invention is intended to create a new type of suspension member for a mobile terminal device. The characteristic features of the invention are stated in the accompanying Claims.

When using the arrangement according to the invention, the fastening of a suspension member for a mobile terminal device is particularly secure and easy. The attachment of the suspension member to the garment is arranged with the aid of a zip fastener.

In one preferred embodiment of the invention, an additional attachment is used at the lower edge of the suspension member. A VELCRO hook and loop fastener attachment or a press-stud attachment can be used as the additional attachment.

According to a second preferred embodiment, the suspension member's attachment zip fastener is of the plastic spiral type, which, as is known, will carry a large load.

According to a third embodiment, the zip fastener is arranged beneath a flap.

Using the arrangement according to the invention achieves several significant advantages over the state of the art. Cost savings accrue through the significant reduction in the manufacturing costs of garments, as the same suspension members can be used in several garments. At the same time, the suspension member can be also made from better and more durable material. Further, the costs of garment care are reduced, as the suspension member can be removed and thus do not increase the weight of garments, for example, when they are sent for laundering.

When using the arrangement according to the invention, the apparel needed by a wearer can comprise, for example, only one piece of full equipment, which includes both the garments of the apparel and detachable suspension members manufactured for different uses, as well as sets of basic apparel, which are otherwise similar, but are without the said suspension members. Thus, when one set of apparel requires care, the wearer can move the suspension member to a similar basic garment.

An additional benefit to the above is that suspension members appropriate to the tasks of the wearer can be added to the same basic set of apparel.

These and other features and advantages of the invention will be more fully understood from the following detailed description of the invention taken together with the accompanying drawings.

DETAILED DESCRIPTION OF THE INVENTION

Figure 1:
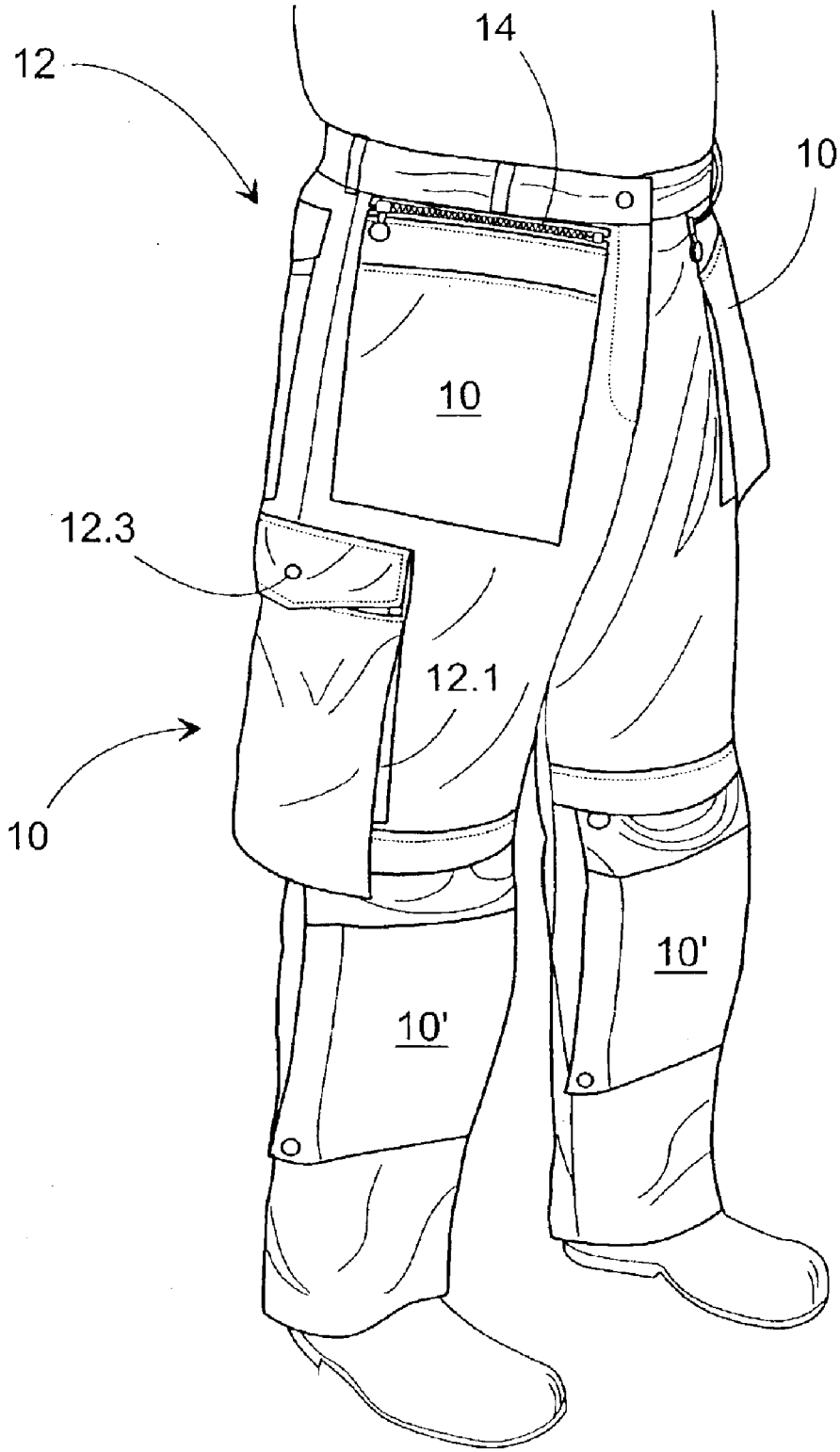
FIG. 1 shows the arrangement according to the invention attached to trousers being worn by the wearer.
Figure 2:
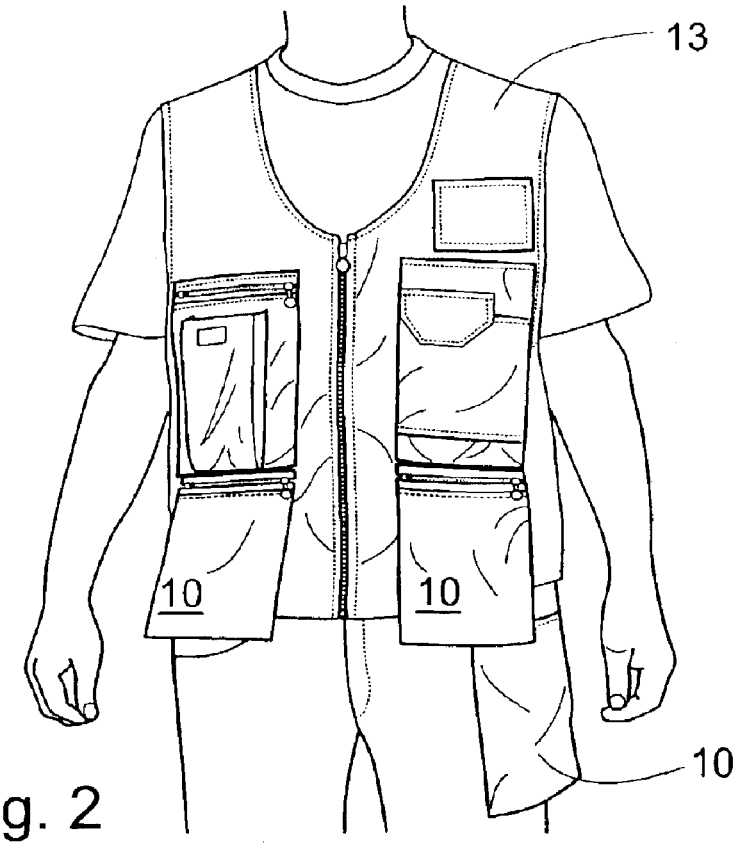
FIG. 2 shows the arrangement according to the invention in a vest.

Referring to FIGS. 1 and 2, it should be stated that the detachable pocket arrangement can be formed in a nearly arbitrary garment, of which the examples in this case are trousers 12 and vests 13. In the figures, the detachable pockets are marked with the reference number 10 and the corresponding knee protector with the reference number 10'.

The pocket is normally formed of a front face and a rear face, with the front face being connected to the rear face, for example, at its side edges and lower edge. The front and rear faces joined together then form a bag-like storage space, open at its upper edge, for carrying objects (not shown) with the garment 12, 13. The pocket can also be part of a series of pockets, in which case they are arranged for several different purposes.

In connection with the arrangement according to the invention, the pocket can also be understood as being, not the storage spaces described above, closed at their side and lower edges, but various suspension elements, in which various tools, for example can be suspended. Generally it is possible to create series of pockets for different purposes, with each pocket being equipped with the same fastening arrangement.

For example, in the case of tape measures and hammers, the front face can be formed so that it is an upwards and downwards opening loop attached to the rear face, through which the hammer can be slipped shaft first, or in which a tape measure with an attachment clip can be placed. Further, the front face can be arranged in connection with the rear face in such a way that it is suitable for carrying pens (not shown).

FIG. 1 shows a pair of trousers 12, with several pockets 10 arranged in them, each suspended with the aid of a horizontal zip fastener 14. At the knees, the trousers 12 have special knee protectors 10', the attachment of which is described later in greater detail. It is particularly advantageous for a worker to be able to put on the knee protectors or padding only when needed.

FIG. 2 show vest 13 with several pocket arrangements according to the invention. In front, there are two pockets 10 arranged to be suspended from their upper parts beneath the pockets permanently attached to the vest. In addition, there is another detachable pocket 10 at the back (not shown).

It should be noted, that the garments 12, 13 shown in these FIGS. 1 and 2 are only by way of examples, so that the pockets 10, 10' according to the invention are in no way restricted to the garments 12, 13, or even to only apparel in general.

Figure 5:
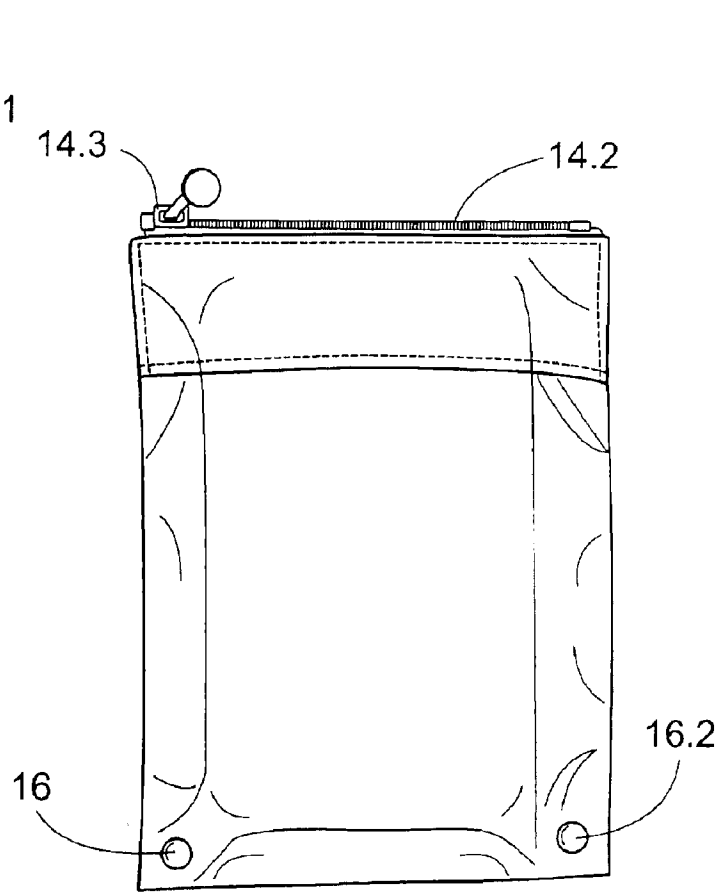
FIG. 5 shows the detachable knee portion.
Figure 4:
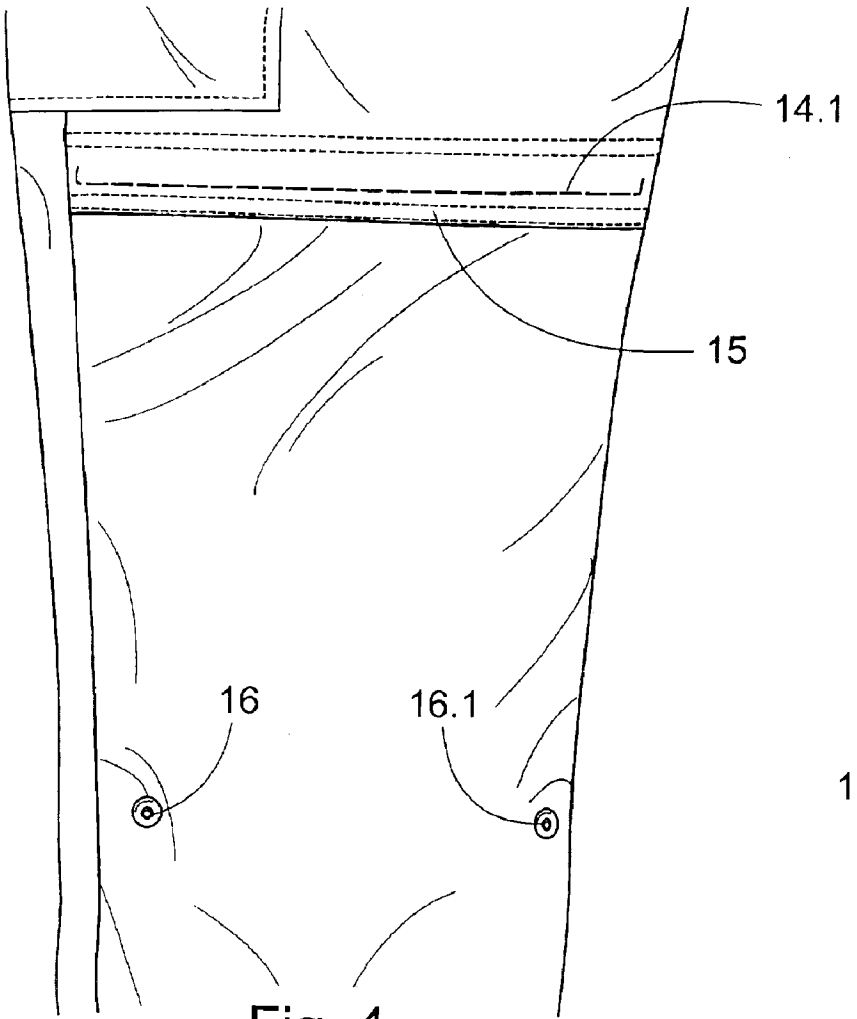
FIG. 4 shows the knee portion of the trousers shown in FIG. 1, without the knee protector attached to it.
Figure 6:
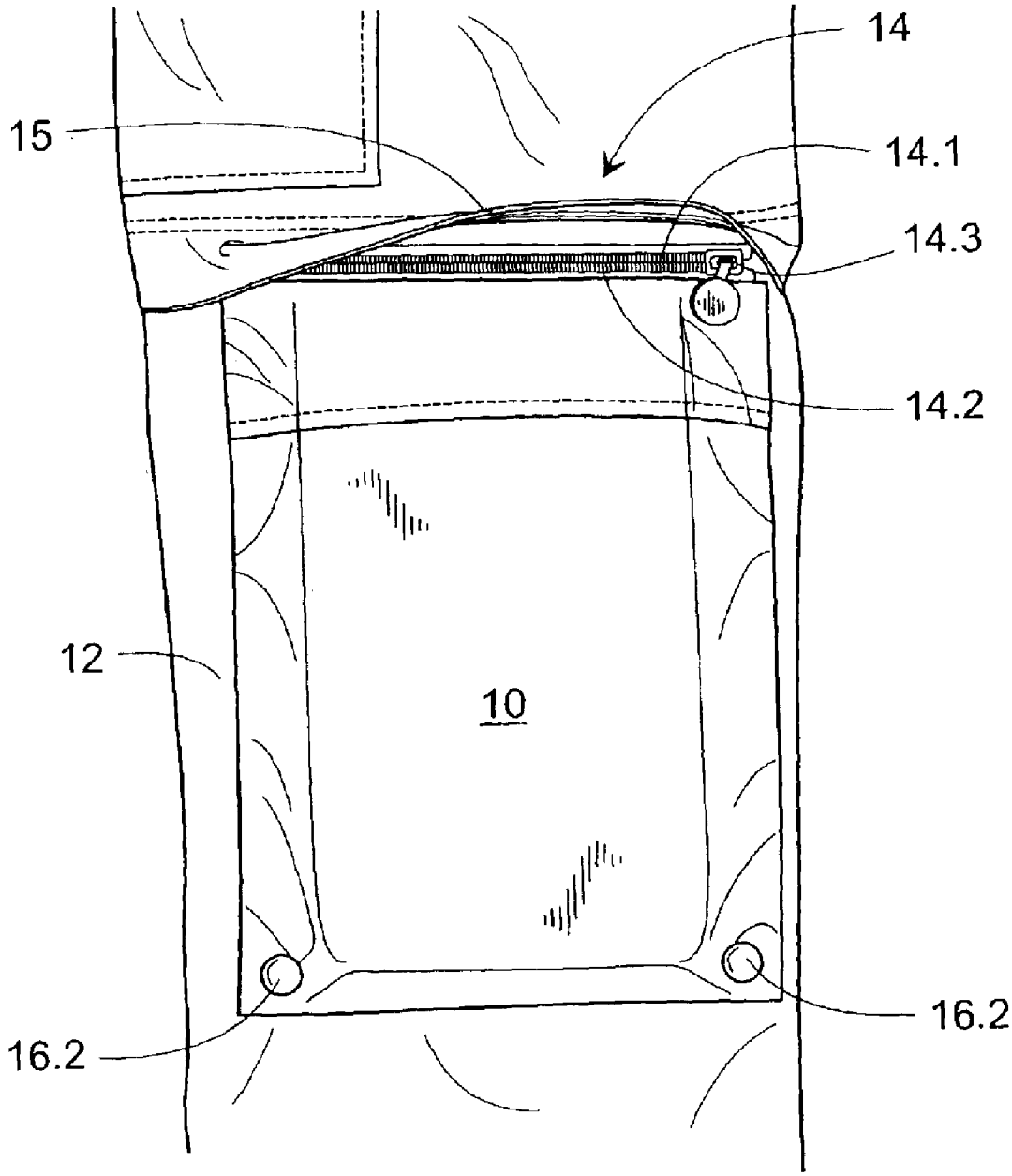
FIG. 6 shows the knee protector of FIG. 5 attached to the trousers.

FIGS. 4–6 show in greater detail the attachment arrangement of the knee protector 10' shown in FIG. 1. In FIG. 4, the knee protector is not being used, so that the half 14.1 of the zip fastener used to attach it remains unseen under the flap 15 arranged in the leg of the trousers 12. The press-stud counter piece 16.1, which is visible below, does not hinder other work.

FIG. 5 shows the knee protector 10' separately. In this case, it actually comprises a special pocket, with a suitable padding sheet placed inside it. A half 14.2 of a zip fastener is stitched to the upper part of the knee protector 10'. The zip fastener is operated by a zipper slide 14.3, which remains on one half or the other, in this case on the half 14.2. The start of the zip also requires stops (not shown), into which the end of the half is pushed. As such, the construction of the zip fastener is conventional. The lower part of the knee protector 10' has male press-stud members 16, which are arranged to fasten to the press-stud counter pieces 16.1 (FIG. 4) in the trousers.

FIG. 6 shows the attachment of the knee protector 10' in detail. Here, the flap 15 covering the zip fastener 14 is shown slightly turned, allowing the closed zip fastener 14 to be seen. The press-stud fasteners (16, 16.1) of the lower part are closed, so that the knee protector 10' is firmly in place.

In place of stud fasteners, it is possible to use hook-and-loop tape, which is as such known, one example of which is VELCRO.

The attachment zip fasteners of the pocket 10 can also be covered with a normal pocket flap 12.3, as shown in FIG. 1.

The zip fasteners used can be, for example, either cast-tooth zip fasteners (plastic or metal), or plastic-coil tooth zip fasteners, such as 05 CF CHAIN P12 DYED HANK200, manufacturer YKK, Japan. The essential property of the zip fastener is its lateral strength, which in some plastic-coil types, for instance, can be as much as 40 kg/2.5 cm.

By using one or several zip fasteners, it is also possible to attach pockets to a garment in series, for example, so that a pocket attached to the garment, using the zip-fastener attachment described above, can have arranged in it, for example, a toothed strip at its lower edge, to which a second zip-fastener attached pocket, in which there is a counter toothed strip for this purpose, can be connected.

Figure 7:
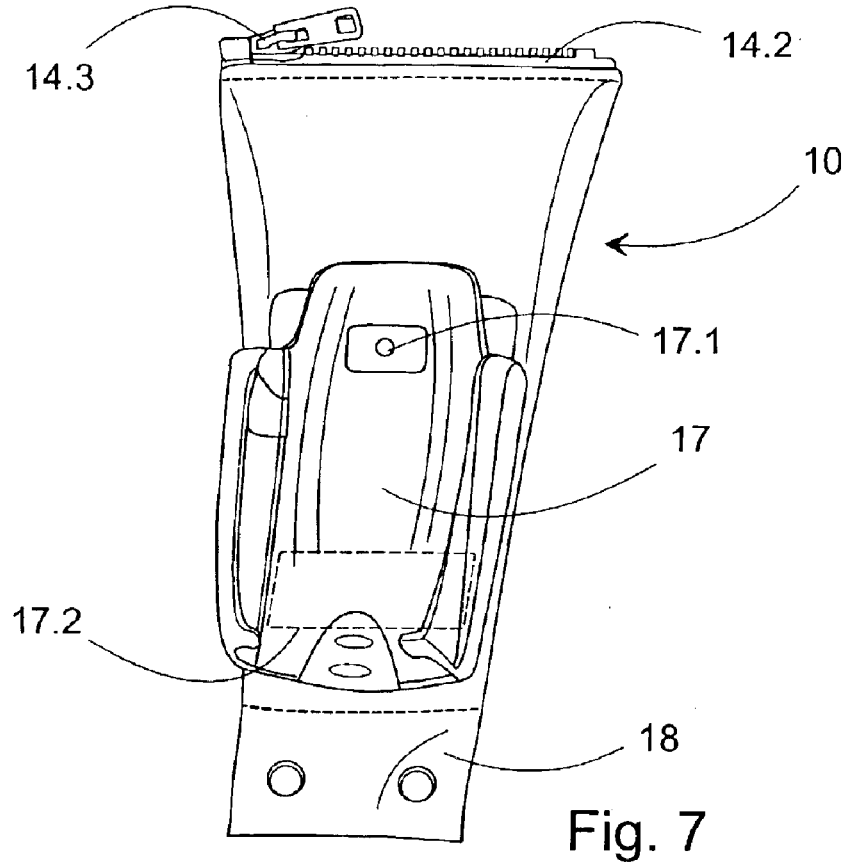
FIG. 7 shows a "pocket", i.e. suspension component, used to suspend a mobile terminal device.
Figure 8:
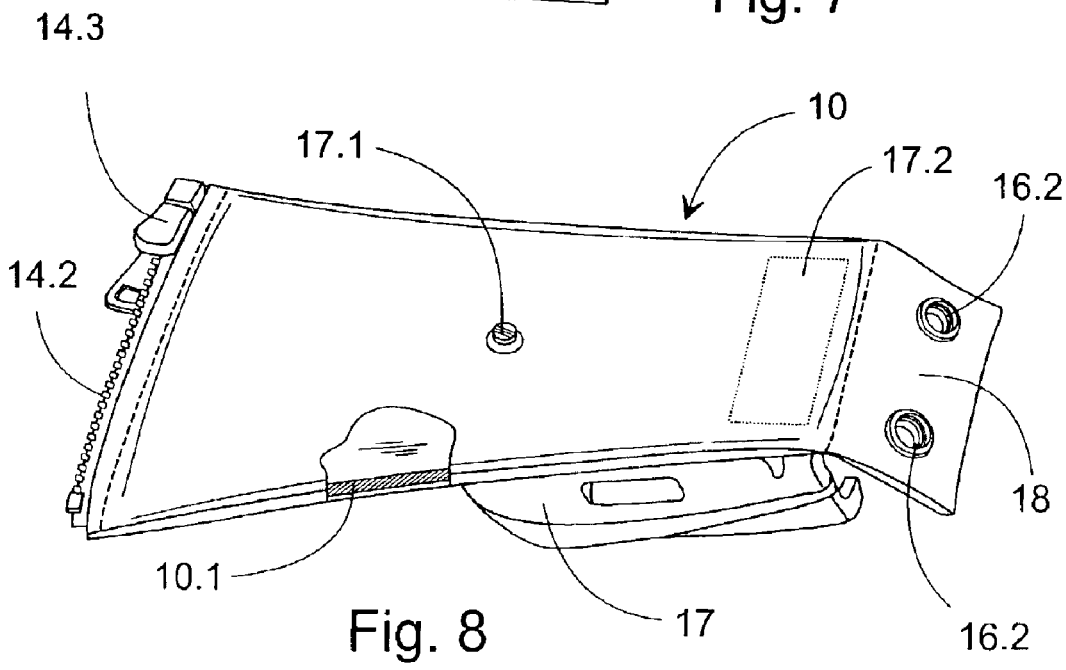
FIG. 8 shows a rear view of the suspension component of FIG. 7.
Figure 9:
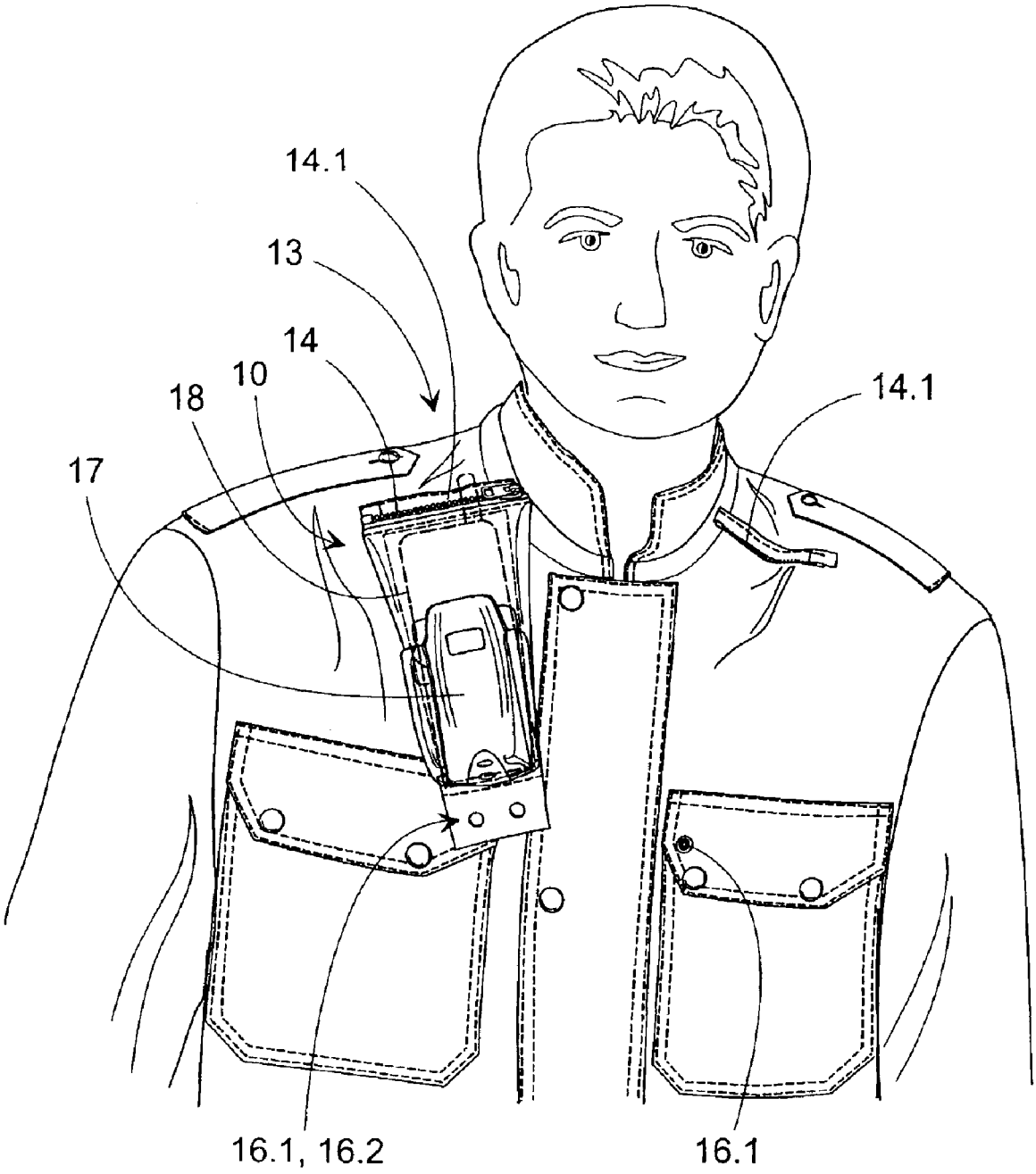
FIG. 9 shows the suspension component of FIG. 7 attached to a jacket.
Figure 10:
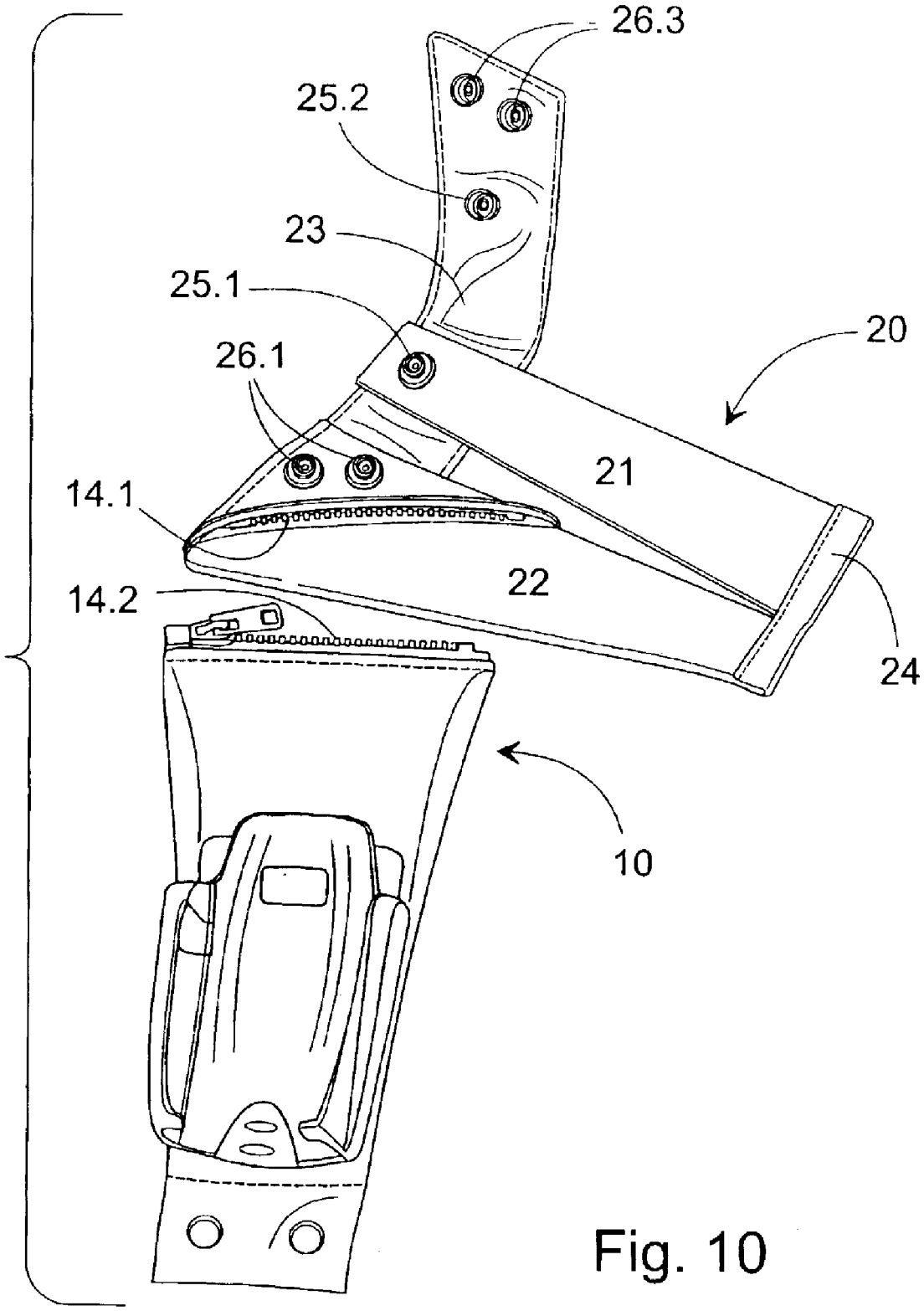
FIG. 10 shows an epaulet attachment component used to attach the suspension component of FIG. 7, FIGS. 11–13 show the stages of attaching the epaulet.

One application of the invention is the suspension of a mobile terminal device, utilizing a "pocket", in this case a holder arrangement 10, according to FIGS. 7 and 8. This is equipped with a half 14.2 of a zip fastener and lower press-stud fasteners 16.2, 16.2, for attaching the holder arrangement 10 to the upper half 14.1 of zip fastener and a press-stud counter piece 16.1, FIG. 9, in a jacket or similar. The outline of the mobile terminal device (e.g. cell phone) placed in the holder 17 is shown by broken lines in the figure. The jacket or other garment requires only small additional pieces to receive the mobile station holder arrangement 10. These are the half 14.1 of the zip fastener and the press-stud counter pieces 16.1 VELCRO hook and loop fasteners can also be used). The attachment is very robust and tight and suitable for a professional use.

The holder arrangement 10 includes a support component, provided with a stiffener plate 10.1 (e.g. polycarbonate), which support component is manufactured from waterproof fabric. The actual mobile station holder 17 is attached to this with a screw 17.1 and VELCRO hook and loop fastener 17.2. The plate 10.1 does not extend fully to the bottom, the bottom part 18 being instead flexible, to facilitate the attachment of the press-stud fasteners. The bottom part 18 has two press-stud fasteners 16.2, allowing the holder arrangement 10 to be put on either the left-hand or the right-hand side. The zip fastener used is a large-size cast-tooth zip fastener, with halves that are easily slid into each other, without seeing them, when the jacket is being worn.

If the jacket does not have a zip-fastener counter piece, this can be made with the aid of a detachable zip-fastener counter piece 20, as shown in FIGS. 10–13. This comprises a counter-piece component 22, an arm component 21, a connector 24, and a band 23. The counter-piece component 22 has the upper half 14.1 of the zip fastener and, at one end, the connector linking the arm component 21 and, at the other end, the band 23. These basic components are made of waterproof fabric and have reinforcements, preferably pieces of artificial leather, inside them.

Figure 14:
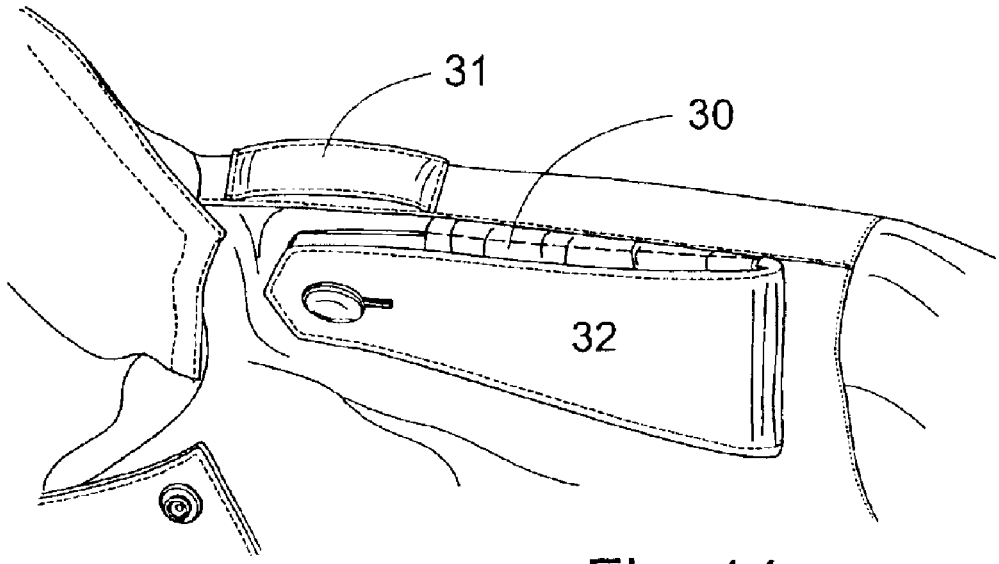
FIG. 14 shows the attachment counter pieces required in the jacket for attaching the epaulet.

FIG. 14 shows the shoulder part of a jacket used by many officials, in which there is an epaulet channel 30 and a loop 31. Insignia of rank (not shown) are placed on a special epaulet band 32, one half of which is slipped through the epaulet channel 30 and the other half is folded over the epaulet channel, after which the ends are attached to each other. The loop 31 is for other attachment purposes. In this case, the epaulet channel 30 and the loop 31 are used to attach a separate zip-fastener counter piece 20.

Figure 11:
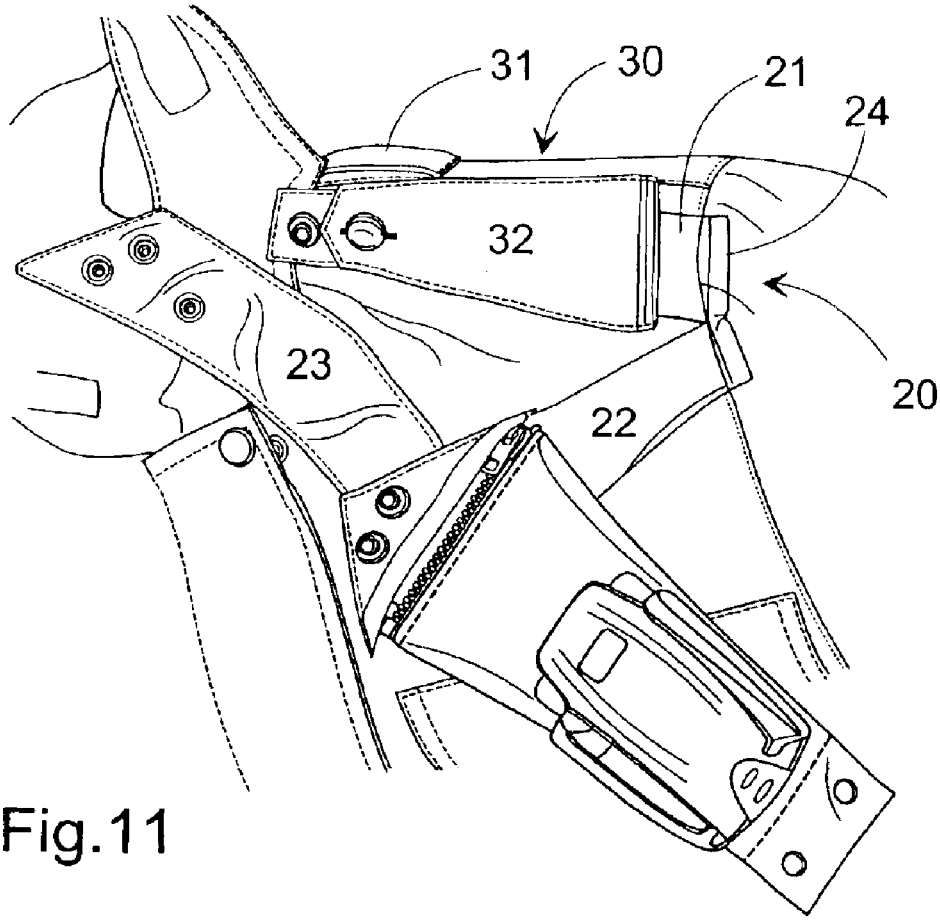

According to FIG. 11, the attachment of the separate zip-fastener counter piece 20 starts with the arm component 21 being pushed through the epaulet channel 30 (as well as through the epaulet band 32). In the next stage (FIG. 12), the band 23 is slipped through the loop 31 from beneath the visible end of the arm component 21 and pulled onto the arm component 21 near to the counter-piece component 22.

Figure 12:
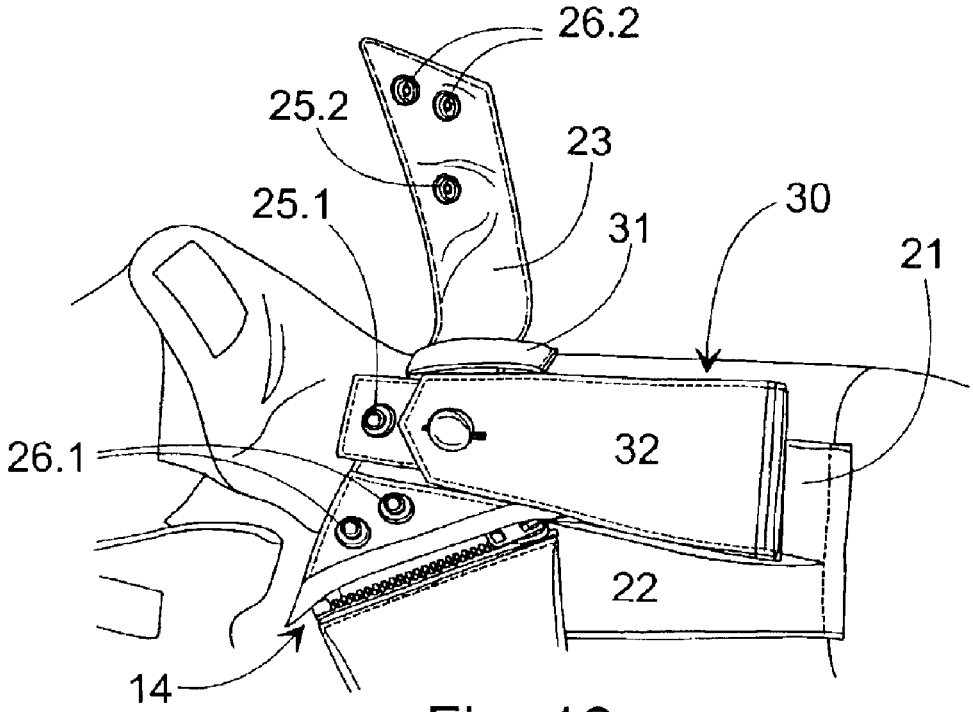
Figure 13:
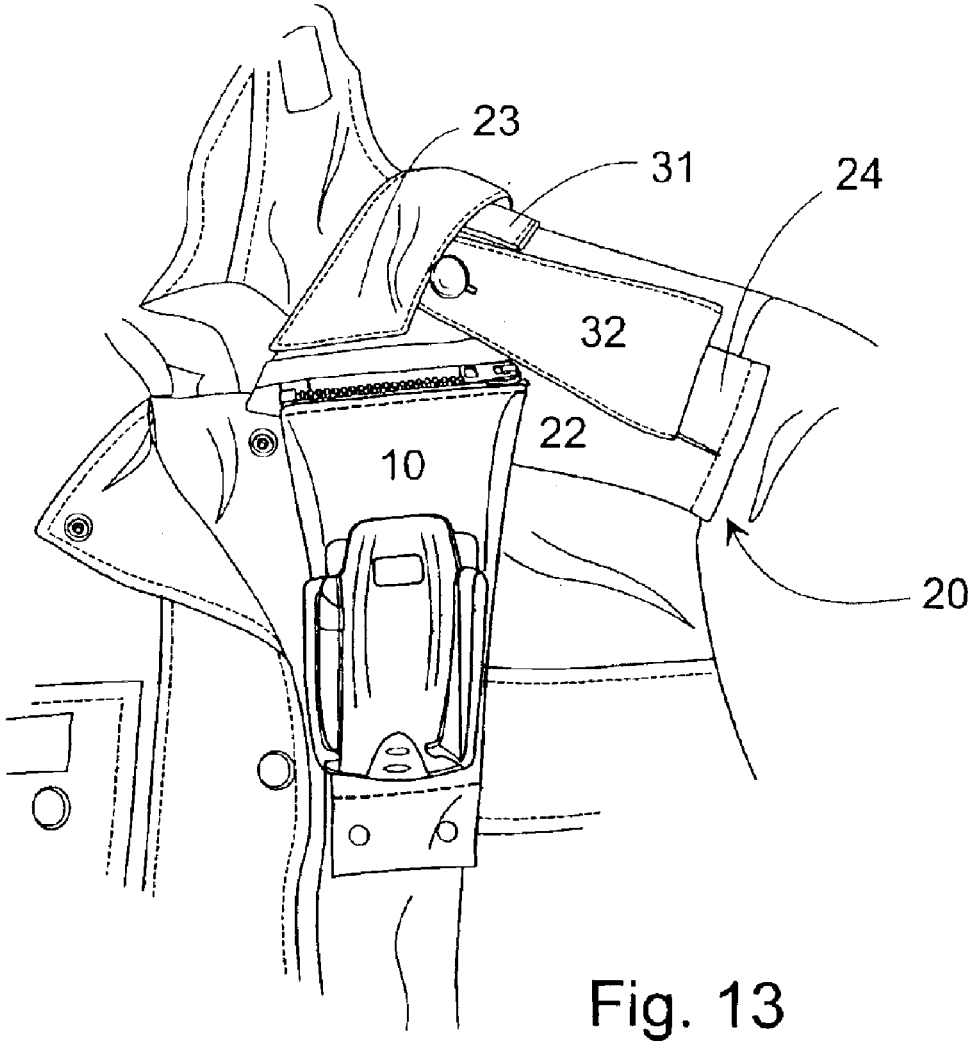

Finally, the press studs 25.2 and 26.2 of the band are pressed into the press-stud counter pieces 25.1 (at the end of the arm component) and 26.1 (in the counter-piece component), resulting in the arrangement of FIG. 13. FIGS. 11–13, show the holder arrangement 10 as being included, but naturally it can be attached afterwards using the zip fastener 14.

In this case, two detachable parts, which can be attached to each other with a zip fastener, are disclosed, i.e. the holder arrangement 10 and the zip-fastener counter piece 20. From this invention, it is easy to derive a permanent combination of them without a zip fastener, which combination, is not, however, an object of the Claims of this application.

Figure 3:
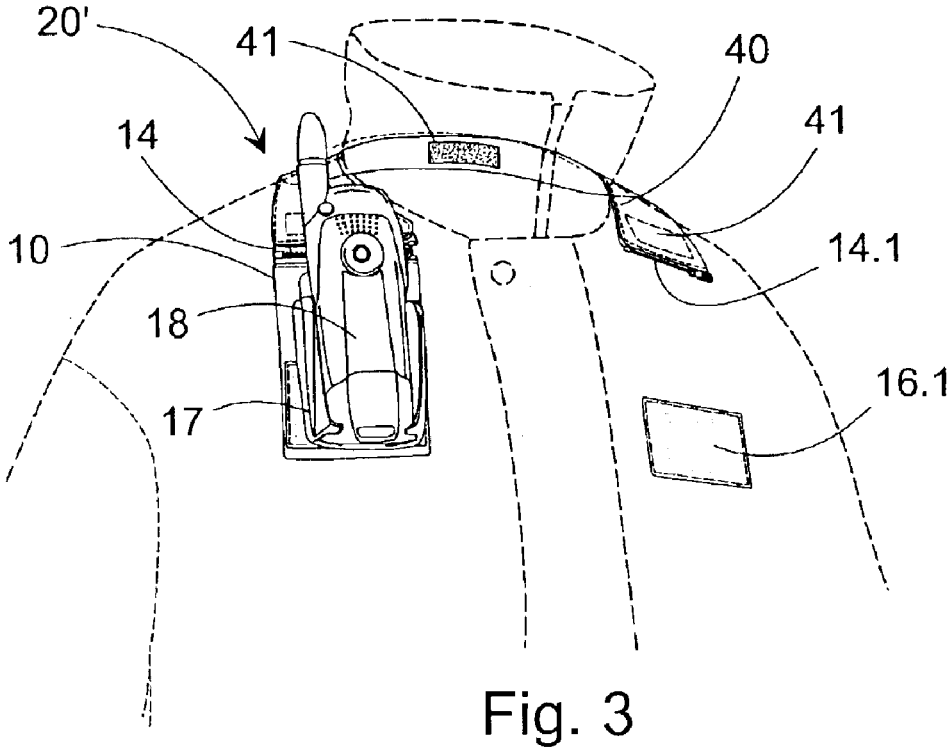
FIG. 3 shows a "pocket", i.e. suspension component, used to suspend a mobile terminal device.

FIG. 3 presents another detachable counter piece 20'. It comprises a strip 40 rounding the neck. The strip 40 has hook-and-loop fasteners 41, one at the each end and one in the middle. In the each end there is a half 14.1 of the zip fastener 14. Again the user can choose to which side he/she hangs the holder 17 for a mobile terminal device 18.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An arrangement in a garment for fastening and detaching at least one suspension member having a holder for a mobile terminal device, in which the arrangement includes an attachment member in the suspension member and an attachment counter piece supported by the garment, and wherein the attachment member and the attachment counter piece are formed of a zip fastener, one half of which is supported by the garment and the other half to the upper edge of the suspension member, so that the suspension member can be completely detached by opening the zip fastener.

2. An arrangement according to claim 1, characterized in that other attachment means are arranged in the lower edge of the suspension member and a corresponding counter piece is arranged in the garment.

3. An arrangement according to claim 2, characterized in that the said other attachment means and counter piece are formed of press-stud attachment devices, one of which is a male press-stud member and the other is a female press-stud counter piece.

4. An arrangement according to claim 1, characterized in that the zip fastener is of the so-called plastic-coil type.

5. An arrangement according to claim 1, characterized in that the garment half of the zip fastener is arranged under a flap.

6. An arrangement according to claim 1, characterized in that the suspension member includes a support component reinforced with a plate and a flexible lower part, and in which the mobile phone holder is attached to this plate.

7. An arrangement according to claim 1 for use with apparel equipped with an epaulet channel, characterized in that the arrangement includes a detachably attached zip-fastener counter piece, which includes an arm component that fits into the epaulet channel.

8. An arrangement according to claim 7 for use with apparel equipped with an epaulet channel and a shoulder loop, characterized in that the suspension of the zip-fastener counter piece takes place not only with the arm component, but also with the aid of a band that is slipped through the shoulder loop, which is secured by attachment means to form a suspension loop.

9. An arrangement according to claim 8, characterized in that at least some of the attachment means are press studs.

10. An arrangement according to claim 8, characterized in that at least one of the supporting components of the zip-fastener counter piece is reinforced with the aid of a piece of artificial leather sewn inside it.

* * * * *